United States Patent [19]

Yonemoto

[11] Patent Number: 4,600,088

[45] Date of Patent: Jul. 15, 1986

[54] APPARATUS FOR CONTROLLING ELEVATORS

[75] Inventor: Masashi Yonemoto, Nagoya, Japan

[73] Assignee: Mitsubishi Denki Kabushiki Kaisha, Tokyo, Japan

[21] Appl. No.: 658,501

[22] Filed: Oct. 9, 1984

[30] Foreign Application Priority Data

Oct. 11, 1983 [JP] Japan ..... 58-189476

[51] Int. Cl.[4] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 4,085,823 | 4/1978 | Caputo et al. | 187/29 R |
| 4,161,235 | 7/1979 | Caputo et al. | 187/29 R |
| 4,263,988 | 4/1981 | Inaba et al. | 187/29 R |
| 4,308,936 | 1/1982 | Caputo et al. | 187/29 R |
| 4,354,577 | 10/1982 | Yonemoto | 187/29 R |
| 4,493,398 | 1/1985 | Kindler | 187/29 R |

*Primary Examiner*—William M. Shoop, Jr.
*Assistant Examiner*—W. E. Duncanson, Jr.
*Attorney, Agent, or Firm*—Leydig, Voit & Mayer, Ltd.

[57] ABSTRACT

An apparatus for controlling an elevator having an induction motor for lifting the cage, a speed instruction device which produces a running speed instruction signal for the cage, a speed controller which generates a torque instruction for the induction motor, a current controller which produces a primary current for the induction motor to control it, a first speed detector which is coupled to the induction motor via a mechanism that increases the input speed to the detector and which feeds speed detection signals back to the speed controller, and a second speed detector which is directly coupled to the rotary shaft of the induction motor and which supplies speed detection signals to the current controller.

5 Claims, 5 Drawing Figures

APPARATUS FOR CONTROLLING ELEVATORS

BACKGROUND OF THE INVENTION

The present invention relates to an apparatus for controlling an elevator, and particularly to an apparatus for controlling an elevator in which a lifting induction motor is driven by a power converter which is capable of varying the voltage and frequency of the power supplied.

Prior Art

It is a trend to increase the speed of elevators accompanying the modern trend toward constructing high-rise buildings. D-C motors without gears are used for lifting these high-speed elevators.

Accompanying a rapid development in semiconductor technology, power converters such as inverters having a large capacity have been constructed. Therefore, it has been attempted to employ an induction motor without gears for high-speed elevators in place of a conventional lifting motor, and to control the induction motor using a semiconductor power converter. The torque of the induction motor can be controlled by a variety of systems. An example is a vector control system of the slip frequency type disclosed in Japanese Patent Laid-Open No. 149314/1977. According to this torque control system of the slip frequency type, the induction motor is controlled according to the following equations:

$$i_1 = \sqrt{i_0^2 + I_2^2}\ \mathrm{EXP}[j\int \omega_1 dt] \tag{1}$$

$$\omega_1 = \omega + \omega_{s1} + \omega_{s2} \tag{2}$$

$$\omega_{s1} = \frac{R_2 I_2}{L_2 i_0} \tag{3}$$

$$\omega_{s2} = \frac{d}{dt}\tan^{-1}\frac{I_2}{i_0} = \frac{i_0}{i_0^2 + I_2^2}\ \frac{dI_2}{dt} \tag{4}$$

$$T = \frac{M^2}{R_2}\, i_0^2 \omega_{s1} \tag{5}$$

where $L_2$ denotes a secondary inductance, M denotes a primary-secondary mutual inductance, $R_2$ denotes a secondary resistance, $i_0$ denotes a secondary exciting current, $i_1$ denotes a primary current, $I_2$ denotes a torque current, T denotes an output torque, $\omega_1$ denotes the angular frequency of the primary current, $\omega$ denotes the angular velocity of the rotor, $\omega_{s1}$ denotes a constant term of slip angular frequency, and $\omega_{s2}$ denotes a transient term of slip angular frequency.

As will be obvious from the above Equation (2), the angular frequency of the primary current is the sum of the anuglar velocity of the rotor and the slip angular frequency. The angular frequency is found from Equations (3) and (4), but the angular velocity of the rotor is measured using a techometer generator, a rotary encoder, or the like. The measured speed of the rotor is used as a speed feedback signal and for calculating the angular frequency of the primary current.

In the vector control system of the slip frequency type employing an induction motor as a lifting motor, however, if an error is contained in the measured angular velocity of the rotor, the effect is the same as an error contained in the calculation of slip angular frequency. Namely, if an error of ±3% is contained in the measured angular velocity of the rotor, the effect is the same as if the slip angular frequency were increased or decreased by 3%, and the output torque changes according to Equation (5). Accordingly, the control of torque loses stability, transient response is deteriorated, and quick response which is the purpose of vector control can not be expected. Moreover, the detected error in the angular velocity of the rotor is integrated in Equation (1), and hence, a control system which uses such signals further loses stability.

In the conventional system for an controlling elevator using a gearless D.C. motor as the lifting motor, use has been made of a speed detector such as a tachometer generator, a rotary encoder, and the like, to feed back the speed. Here, as is well known, a gearless lifting motor runs at a low speed. When applied to an elevator, its speed must be stably controlled covering a range where the speed is close to zero. Therefore, the running speed of the speed detector must be increased by a frictional drive or by a belt drive to increase the output thereof. When the speed detector is coupled to the motor via a frictional drive or belt drive, however, the diameter of the pulley may change due to wear or changes in temperature, and a relatively large error will then be contained in the detected speed. Therefore, even if the conventional speed detector is utilized for the above-mentioned vector control system of the slip frequency type, it is not possible to stably control the torque of the induction motor.

SUMMARY OF THE INVENTION

The present invention was accomplished to eliminate the above-mentioned defects, and its object is to provide an apparatus for controlling elevators which is capable of stably controlling the elevator over a wide range covering a range where the speed is nearly zero, by driving the lifting induction motor via a power converter.

In order to achieve the above-mentioned object, the present invention is constructed as described below. Namely, an apparatus for controlling an elevator of the present invention comprises:

an induction motor for lifting the cage;

a speed instruction device which produces a running speed instruction signal for the cage;

a speed controller which generates a torque instruction for the induction motor;

a current controller which produces a primary current for the induction motor to control it;

a first speed detector which is coupled to the induction motor via a mechanism that increases the revolution and which feeds speed detection signals back to the speed controller; and a second speed detector which is directly coupled to the rotary shaft of the induction motor and which supplies speed detection signals to the current controller.

Thus, an apparatus for controlling elevators according to the present invention employs a speed detector for a vector control system of the slip frequency type, which is directly coupled to the shaft of the motor to increase the detection precision, and controls the torque of the induction motor. Further, the speed detector which is used for controlling the speed is driven via a mechanism for increasing the speed to produce increased output. Therefore, the speed can be stably controlled covering a range of very low speeds.

DESCRIPTION OF THE PREFERRED EMBODIMENT

Figure 1:
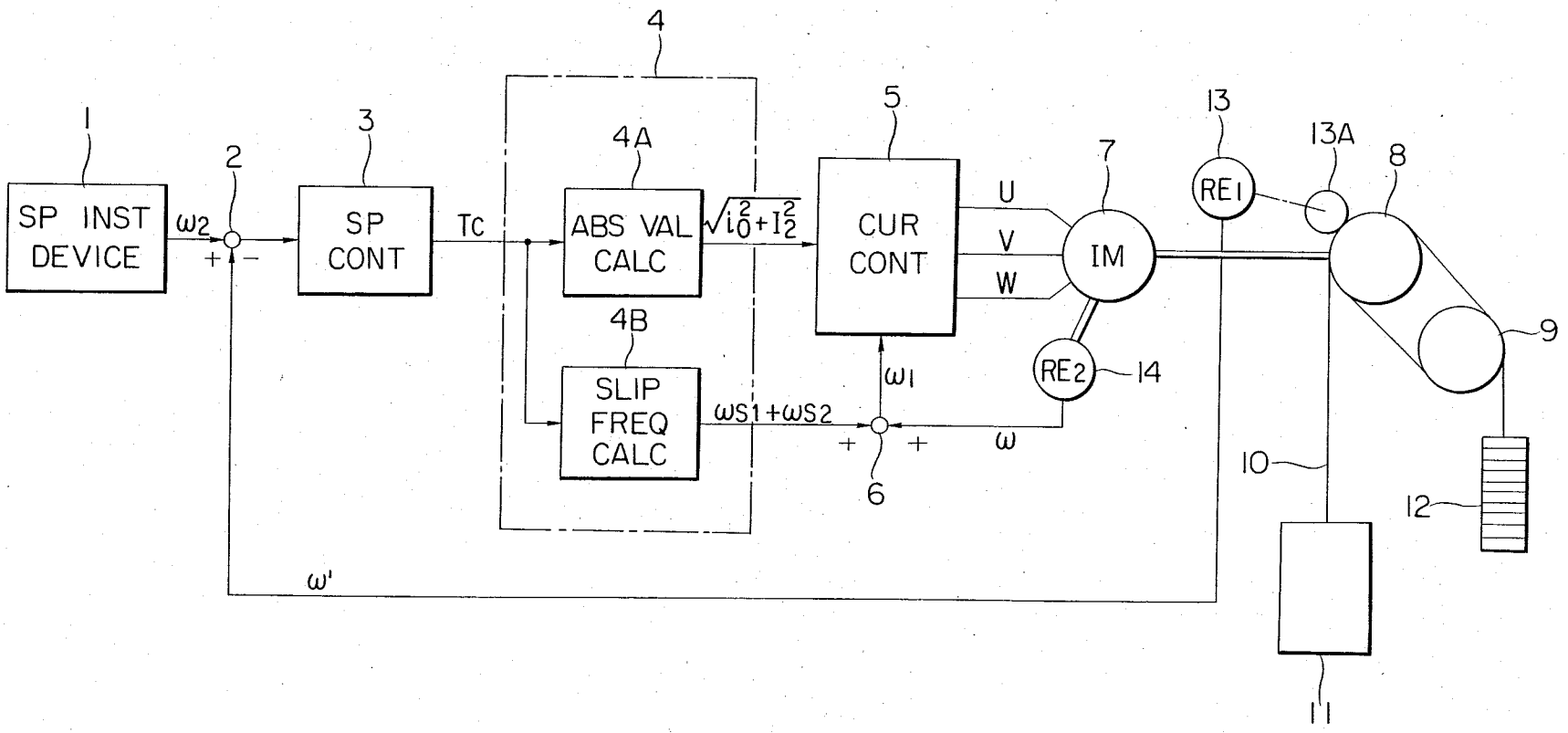
FIG. 1 is a block diagram of an apparatus for controlling an elevator according to an embodiment of the present invention.
Figure 2:
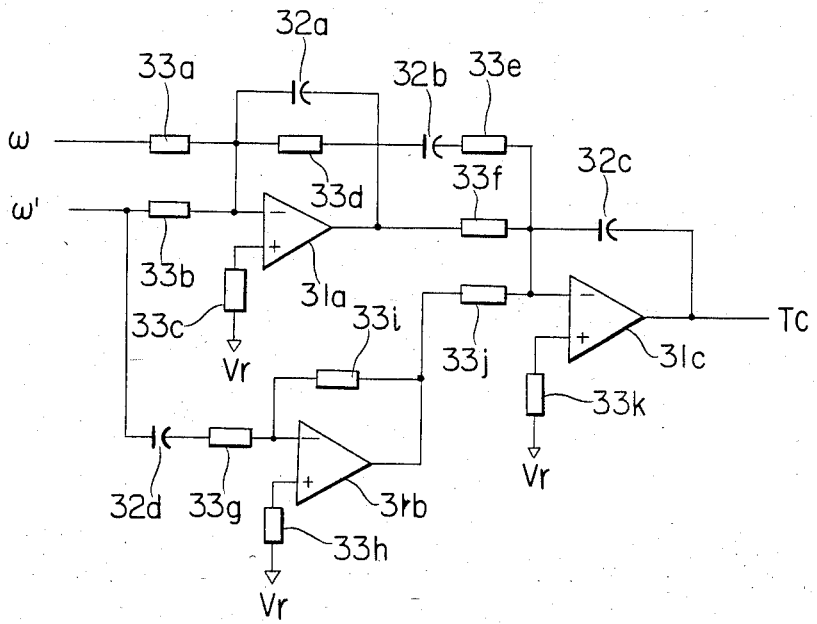
FIG. 2 is a diagram which concretely shows the circuit of an adder of FIG. 1.
Figure 3:
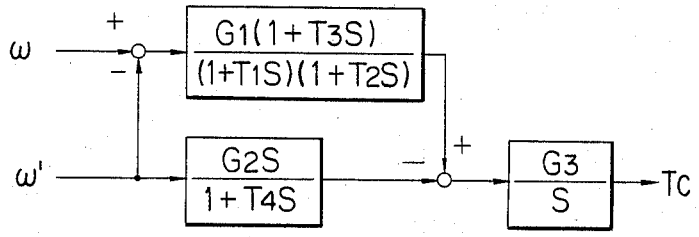
FIG. 3 is a diagram showing a process of arithmetic operation performed by the circuit of FIG. 2.

FIG. 1 is a block diagram of an apparatus for controlling an elevator according to an embodiment of the present invention, wherein reference numeral 1 denotes a speed instruction device which generates a running speed instruction signal $\omega_2$ to control the running speed of the elevator, and 2 denotes an adder which finds the difference between the running speed instruction signal $\omega_2$ and a speed detection signal $\omega'$ generated by a rotary encoder 13 that will be described later, and which produces a speed deviation signal. Reference numeral 3 denotes a speed controller which calculates speed deviation signals to generate a torque instruction signal Tc. The adder 2 and the speed controller 3 are constituted by operational amplifiers 31*a* to 31*c*, capacitors 32*a* to 32*d*, and resistors 33*a* to 33*k*, as shown in FIG. 2. The thus constructed circuits execute the arithmetic operation shown in FIG. 3. Here $G_1$ to $G_3$ denote gains of the operational amplifiers 31*a* to 31*d*, $T_1$ to $T_4$ denote time constants, and S denotes d/dt.

In FIG. 1, reference numeral 4 denotes a current instruction device which receives the torque instruction signal Tc, and which calculates an absolute primary current $\sqrt{i_0^2+I_2^2}$ for an induction motor 7 that will be mentioned later as well as a slip angular frequency $\omega_{s1}+\omega_{s2}$. The current instruction device 4 consists of an absolute value calculator 4A and a slip frequency calculator 4B. Reference numeral 5 denotes a current controller which controls the primary current for the gearless induction motor 7 relying upon the absolute primary current $\sqrt{i_0^2+I_2^2}$, and 6 denotes an adder which adds the slip angular frequency $\omega_{s1}+\omega_{s2}$ and a speed detection signal $\omega$ generated by a rotary encoder 14 that will be mentioned later. The output signal $\omega_1$ of the adder 6 is supplied to the current controller 5.

Figure 4:
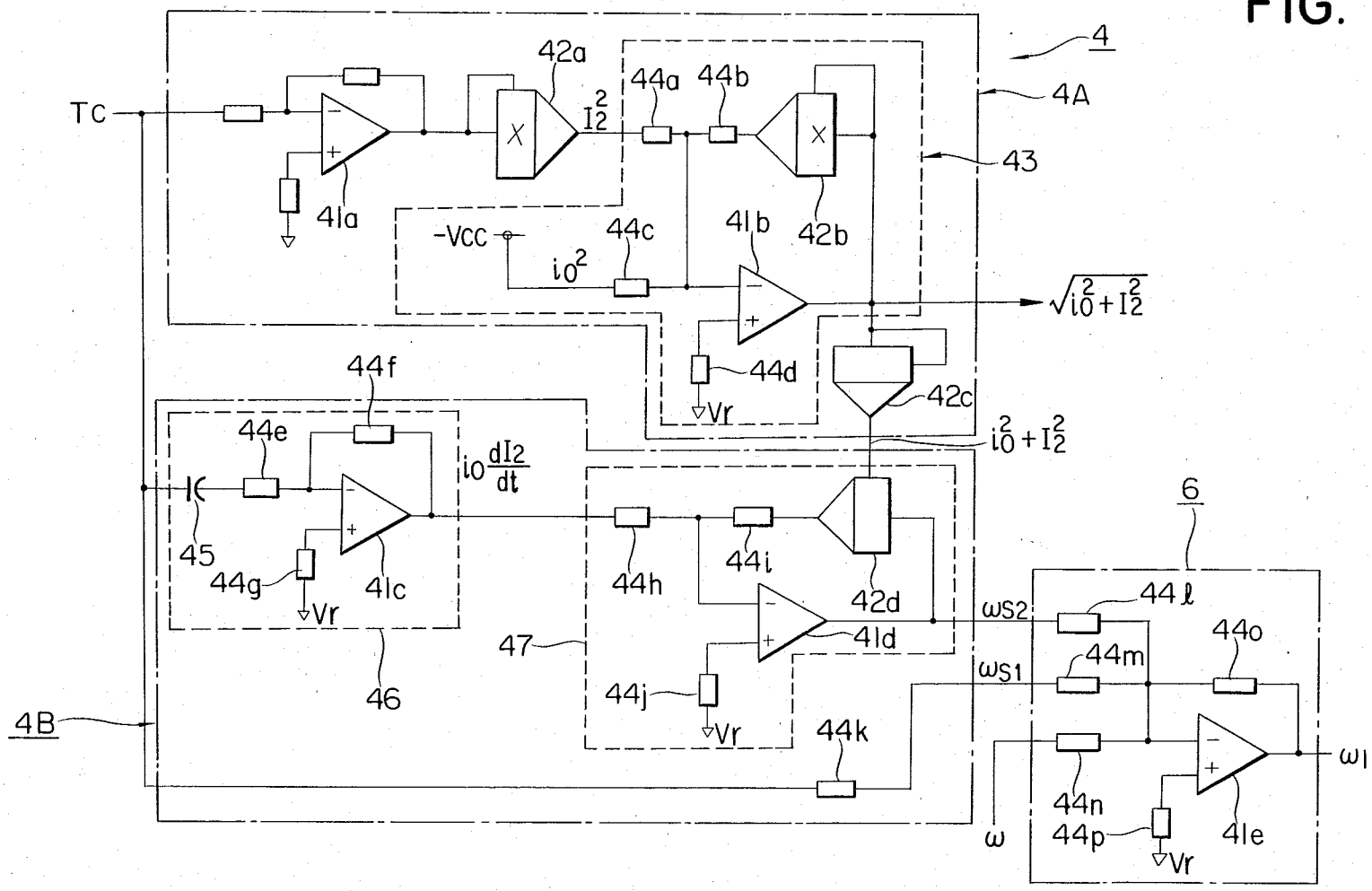
FIG. 4 is a diagram which concretely shows the circuits of a current instruction device and the adder.

Here, the current instruction device 4 and the adder 6 are constituted, for example, by the circuits shown in FIG. 4, in which the torque instruction signal Tc is amplified by an operational amplifier 41*a*, and is subjected to square-power calculation through a square-power calculation circuit 42*a* to obtain $I_2^2$. The output signal $I_2^2$ is subjected to root calculation in a root calculation circuit 43, whereby $I_2^2$ and $i_0^2$ are produced as the absolute primary current $\sqrt{i_0^2+I_2^2}$. Here, the root calculation circuit 43 consists of an operational amplifier circuit 41*b*, a square-power calculation circuit 42*b*, and resistors 44*a* to 44*d*. The output signal of the root calculation circuit 43 passes through a square-power calculation circuit 42*c*, whereby an output signal $i_0^2+I_2^2$ is supplied to the slip frequency calculation circuit 4B.

The slip frequency calculation circuit 4B comprises a differentiation circuit 46 which consists of a capacitor 45, an operational amplifier 41*c*, and resistors 44*e* to 44*g*, and which differentiates the torque instruction signal Tc to produce a differentiated output $i_0dI_2/dt$; a divider circuit 47 which comprises a square-power calculation circuit 42*d*, an operational amplifier circuit 41*d*, and resistors 44*h* to 44*j*, and which divides the output signal $i_0dI_2/dt$ of the differenctiation circuit 46 by the output signal $i_0^2+I_2^2$ of the absolute value calculation circuit 4A to obtain an output signal $\omega_{s2}$; and a resistor 44*k* which produces the torque instruction signal Tc as an output signal $\omega_{s1}$. Furthermore, the adder 6 consists of resistors 44*l* to 44*n* for adding signals $\omega_{s1}$, $\omega_{s2}$ produced by the slip frequency calculator 4B and the speed detection signal $\omega$ together, and an operational amplifier 41*e* and resistors 44*o*, 44*p*.

Figure 5:
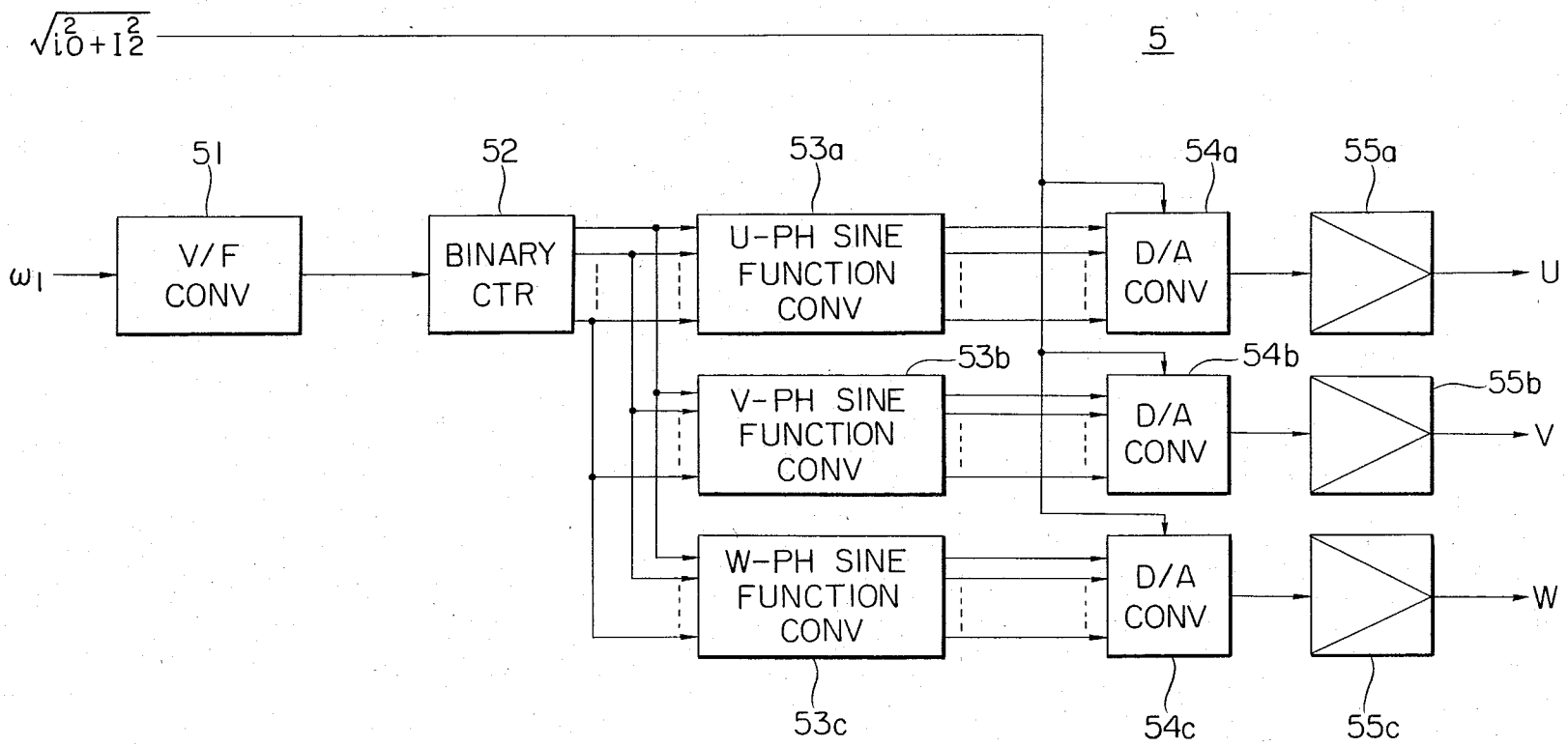
FIG. 5 is a diagram which concretely shows the circuit of a current controller of FIG. 1.

The current controller 5 is constructed as shown in FIG. 5, wherein reference numeral 51 denotes a voltage-frequency converter circuit which converts the voltage of the running detection signal $\omega_1$ into a corresponding frequency, 52 denotes a binary counter which counts the outputs of the voltage-frequency converter circuit 51, reference numerals 53*a* to 53*c* denote U-, V-, and W-phase sine function converter circuits that receive the output signals of the binary counter 52, and that generate sine functions corresponding to the U-, V-, and W-phases, reference numerals 54*a*, to 54*c* denote digital-to-analog converters that convert digital sine functions generated by the U-, V-, and W-phase sine converters 53*a* to 53*c* into analog signals, and reference numerals 55*a* to 55*c* denote power amplifiers which amplify output signals produced by the digital-to-analog converters 54*a* to 54*c* and which supply the amplified output signals to the lifting induction motor 7.

Returning to FIG. 1, reference numeral 8 denotes a sheave driven by the induction motor 7, 9 denotes a deflector wheel, 10 denotes a rope running between the sheave 8 and the deflector wheel 9, 11 denotes a cage hanging from one end of the rope 10, 12 denotes a counter-weight hanging from the other end of the rope 10, and 13 denotes a rotary encoder which is driven at an increased speed by a pulley 13A that rotates in contact with the sheave 8. The encoder generates running detection signals $\omega'$. Reference numeral 14 denotes a rotary encoder which is directly driven by the induction motor 7, and which generates running detection signals $\omega$.

In the thus constructed apparatus for controlling an elevator, the speed instruction device 1 generates a running speed instruction signal $\omega_2$ for the elevator. The adder 2 adds the running speed instruction signal $\omega_2$ to the speed detection signal $\omega'$ generated by the rotary endoder 13, and produces a speed deviation component for these two signals. The speed deviation component is amplified by the speed controller 3 and is produced as a torque instruction signal Tc which will be supplied to the current instruction device 4. The absolute value calculator 4A calculates an absolute primary current $\sqrt{i_0^2+I_2^2}$ and the slip frequency calculator 4B calculates a slip angular frequency $\omega_{s1}+\omega_{s2}$. The thus calculates absolute primary current $\sqrt{i_0^2+I_2^2}$ is calculated by the current controller 5 according to the aforementioned Equation (1), whereby a primary current $i_1$ is found and is supplied to the induction motor 7. Therefore, the induction motor 7 is energized by the primary current $i_1$, and the sheave 8 is driven to move the cage 11.

As the sheave 8 rotates, the pulley 13A is driven, and the rotary encoder 13 directly coupled to the shaft of the pulley 13A generates speed detection signals $\omega'$ that represent the running speed of the cage 11. The speed detection signals $\omega'$ are input to the adder 2 to find the deviation relative to the running speed instruction signals $\omega_2$. Namely, the speed detection signals $\omega'$ are fed back such that the torque instruction signal Tc generaged by the speed controller 3 is corrected to an optimum value.

Accompanying the rotation of the induction motor 7, the rotary encoder 14 which is directly coupled to the rotary shaft thereof generates speed detection signals $\omega$ that represent the revolving speed of the induction motor 7. The speed detection signals $\omega$ are added by the adder 6 to the slip angular frequency $\omega_{s1}+\omega_{s2}$ supplied from the slip frequency calculator 4B, whereby the calculation is executed in accordance with the aforementioned Equation (2), and an output signal $\omega_1$ that serves as an angular frequency instruction for the primary current $i_1$ is generated and supplied to the current controller 5.

The rotary encoder 14 is directly coupled to the rotary shaft of the induction motor 7, and hence its precision for detecting speed does not change since it has no pulley that might change in dimensions. Therefore, the rotary encoder 14 stably produces the speed detection signals at all times.

Here, the gearless induction motor 7 rotates at such a low speed that there may arise the doubt that pulses will not be obtained in sufficient numbers if the rotary encoder 14 is directly coupled to the rotary of the induction motor. However, there arises no problem because of the resons described below. In the vector control system of the slip frequency type, it has been learned through past experimental data that it is generally sufficient if the angle of rotation of the rotor is detected at a precision of one pulse per electrical degree. In an induction motor having four poles, for instance, the number of electrical degrees of one turn is 720°. Therefore, the rotary encoder should be capable of generating 720 pulses or more per turn of the rotor. Similarly, in the case of an induction motor having six poles, the rotary encoder should generate 1080 pulses per turn, and in the case of an induction motor having eight poles, the rotary encoder should generate 1440 pulses per turn. Rotary encoders which produce not more than 2000 pulses per turn can be easily manufactured, and have been placed in the market in a variety of models. Therefore, any one of such models can be employed in the present invention.

Considered below is the number of necessary pulses that must be generated by the rotary encoder 13. If the rated speed of the elevator is 300 m/min., and the diameter of the sheave 8 is 0.71 m, the rated number of revolutions of the motor 7 is 135 rpm. If the rotary encoder which is capable of generating 2000 pulses per turn is directly coupled to the sheave 8, the pulse frequency will be 4483 Hz when operated at the rated speed (300 m/min.). However, the elevator must be controlled at a speed of as slow as about one meter per minute. When controlled at a speed of one meter per minute, the pulse frequency is as small as 15 Hz. The frequency response of the system for controlling the elevator speed, however, must have been considered up to, usually, about 30 Hz. With the above-mentioned frequency of 15 Hz, therefore, the number of pulses is not sufficient, and performance for controlling the speed is deteriorated in a range of slow speed.

Therefore, if the pulley 13A is frictionally driven by the sheave 8 and the rotary encoder 13 is driven at an increased speed via the pulley 13A, the pulse frequency can be increased to higher than 100 Hz even in a range of very slow speed. In this case, however, errors are generated in the speed detection signals $\omega'$ if the diameter of the pulley 13A changes. Changes in the speed detection signals $\omega'$ are equivalent to changes in the speed instruction signals $\omega_2$. However, errors in the speed detection signals $\omega'$ are usually about 1 to 2%, and are smaller than 3% at the greatest. Even if the speed instruction signals $\omega_2$ are equivalently changed by the amount mentioned above, and the running speed of the cage 11 is changed, there will be no problem in practice.

Although the rotary encoder was used as a speed detector in the above-mentioned embodiment, similar effects can be obtained even when a tachometer generator is sued. Furthermore, the method of driving the rotary encoder for detecting the running speed of a cage need not be limited to a frictional drive but may also be a belt drive or the like provided it is capable increasing the revolving speed.

What is claimed is:

1. An apparatus for controlling an elevator comprising:

an induction motor for lifting a cage, said motor having a rotary output shaft a speed instruction device which produces a running speed instruction signal for said cage;

a speed controller which generates a torque instruction for said induction motor;

a current controller which produces a primary current for the induction motor to control it;

a first speed detector which is coupled to said induction motor via a mechanism that increases the rate of revolutions supplied to said first speed detector and which feeds speed detection signals back to said speed controller; and a second speed detector which is directly coupled to the rotary output shaft of said induction motor and which supplies speed detection signals to said current controller.

2. An apparatus for controlling an elevator as set forth in claim 1, wherein said speed controller is provided with a speed deviation signal that is obtained by comparing a speed instruction from said speed instruction device with a speed detection signal from said first speed detector.

3. An apparatus for controlling an elevator as set forth in claim 1, wherein a current instruction device is connected to the output side of said speed controller, and said current instruction device, upon receipt of a torque instruction from said speed controller, forms a signal for generating a primary current instruction and supplies it to said current controller, and further forms a slip frequency instruction signal responsive to said torque instruction and supplies it to said current controller, and wherein a deviation signal between a speed detection signal of said second speed detector portion and said slip frequency instruction signal is supplied to said current controller while it is being provided with said slip frequency instruction signal.

4. An apparatus for controlling an elevator as set forth in claim 3, wherein said current controller forms said primary current upon receipt of a signal for said primary current produced by said current instruction device and a deviation signal related to said slip frequency.

5. An apparatus for controlling an elevator as set forth in claim 1, wherein said first speed detector detects speed by detecting the rotation of a sheave that is driven by said induction motor which lifts said cage.

* * * * *